US006202767B1

(12) United States Patent
Friis

(10) Patent No.: US 6,202,767 B1
(45) Date of Patent: Mar. 20, 2001

(54) DOUBLE ACTING HYDRAULIC JAR

(75) Inventor: Niels Christian Olaf Friis, Kintore (GB)

(73) Assignee: International Petroleum Equipment Limited, Inverurie (GB)

( * ) Notice: Subject to any disclaimer, the term of this patent is extended or adjusted under 35 U.S.C. 154(b) by 0 days.

(21) Appl. No.: 09/269,131

(22) PCT Filed: Sep. 18, 1997

(86) PCT No.: PCT/GB97/02531

§ 371 Date: Mar. 19, 1999

§ 102(e) Date: Mar. 19, 1999

(87) PCT Pub. No.: WO98/12414

PCT Pub. Date: Mar. 26, 1998

(30) Foreign Application Priority Data

Sep. 20, 1996 (GB) ..... 9619722

(51) Int. Cl.[7] ..... E21B 31/113
(52) U.S. Cl. ..... 175/297; 166/178
(58) Field of Search ..... 175/293, 296, 175/297, 301, 304; 166/778, 301, 99; 173/134

(56) References Cited

U.S. PATENT DOCUMENTS 3,221,826 12/1965 Webb .
4,109,736 8/1978 Webb et al. ..... 175/297
4,456,081 6/1984 Newman ..... 175/297
5,033,557 7/1991 Askew ..... 175/297

FOREIGN PATENT DOCUMENTS 2286212 9/1995 (GB) .

*Primary Examiner*—Robert E. Pezzuto
(74) *Attorney, Agent, or Firm*—Ratner & Prestia

(57) ABSTRACT

A jar mechanism comprises an outer body member an, inner body member which is movably mounted on the outer body member, and a fluid chamber which is defined by the inner and outer body members. A resistance mechanism is in fluid communication with the fluid chamber. The inner and outer body members are moveable relative to each other between a first configuration in which the resistance mechanism resists relative movement therebetween, and a second configuration in which the resistance mechanism substantially does not resist relative movement therebetween. The resistance mechanism comprises two valve devices, where each valve device resists movement of fluid within the fluid chamber in one direction and the valve devices are arranged to resist the movement of fluid in opposite directions. A releasable locking mechanism locks the inner body member with respect to the outer body member, where a piston section permits a load to be applied between the body members after the locking mechanism has released.

26 Claims, 12 Drawing Sheets

DOUBLE ACTING HYDRAULIC JAR

This invention relates to a jar mechanism, and in particular a jar mechanism for imparting a jarring impact to an object located in a borehole.

Drilling jars are typically installed in a drill string and enable an operator to deliver a jarring impact to the drill string if the drill string becomes stuck in the borehole being drilled.

Drilling jars generally consist of an outer housing and an inner mandrel. The housing is generally connected to the drill string below the jar and the inner mandrel is connected to the drill string above the jar. The inner mandrel has a shoulder which forms a hammer, and the housing has an internal shoulder which forms an anvil. The outer housing and the inner mandrel are releasably connectable such that the hammer and the anvil are held in spaced apart relationship, until tension or compression exerted between the outer housing and inner mandrel exceeds a certain level. When this occurs, the outer housing and the inner mandrel are released and the hammer is permitted to travel upwardly or downwardly to strike the anvil, thus creating a jarring force on the drill string below the jar.

Conventionally, hydraulic drilling jars are known to have internal hydraulic chambers that are pressure compensated with the annulus between the hydraulic drilling jar and the well bore by apertures in the outer housing. These hydraulic drilling jars have the disadvantage that the apertures present weak points in the outer housing which can fail.

SUMMARY OF THE INVENTION

According to a first aspect of the present invention there is provided a jar mechanism comprising an outer body member; an inner body member movably mounted on the outer body member; a releasable locking mechanism for locking the inner body member with respect to the outer body member; and a piston section which permits a load to be applied between the inner body member and the outer body member after the locking mechanism has released.

Preferably, the jar mechanism further comprises at least one flow passage to permit fluid located in the annulus between the outer body member and the inner body member to flow from one side of the locking mechanism to the other.

Preferably, the locking mechanism is released by applying a force greater than a threshold force between the inner body member and the outer body member. Typically, the locking mechanism comprises a first lock member on one of the outer and inner body members, and a second lock member on the other body member, the first and second lock members being engageable with each other to lock the body members together.

Typically, one of the first and second lock members is biassed towards the other by a biassing mechanism. Preferably, the first lock member is mounted on the outer body member and the first lock member is biassed towards the second lock member by the biassing mechanism.

Typically, the second lock member comprises a formation on the inner body member, and preferably, the formation has a profile that may be engaged by a corresponding profile on the first lock member.

Typically, the biassing mechanism comprises a pair of spaced rings, where the first lock member is located between the rings, and at least one biassing device that biasses the first and second rings toward the first lock member.

Preferably, the biassing device exerts a biassing force in a direction transverse to the direction of movement of the first lock member. Typically, the biassing force is exerted in a direction substantially parallel to the direction of movement of the inner body member and the first lock member moves in a direction substantially perpendicular to the direction of movement of the inner body member relative to the outer body member.

Typically, the side of each of the spaced rings adjacent the first lock member are tapered, and the ends of the first lock member are correspondingly tapered with respect to the rings such that the biassing device biasses the rings towards each other to bias the first lock member towards the second lock member.

Preferably, the first lock member comprises a plurality of segments, the segments being arranged circumferentially around the second lock member, and the sum of the angles subtended by the segments is less than 360°. Typically, there is a flow passage between each segment.

Typically, the spaced rings each have a flow passage formed therein. Preferably, the flow passages are formed on the inner and outer circumference of the rings.

According to a second aspect of the present invention, there is provided a jar mechanism comprising an outer body member; an inner body member movably mounted on the outer body member; a fluid chamber defined by the inner and the outer body members; and a resistance mechanism in fluid communication with the fluid chamber; the inner and the outer body members being movable relative to each other between a first configuration in which the resistance mechanism resists relative movement between the inner and the outer body members, and a second configuration in which the resistance mechanism resists relative movement of the inner and the outer body members to a lesser extent than the first configuration; the resistance mechanism comprising two valve devices, each valve device resisting movement of fluid within the fluid chamber in one direction and the valve devices being arranged to resist the movement of fluid in opposite directions. Preferably, the valve devices are arranged in a spaced apart relationship, and more preferably, the valve devices divide the fluid chamber into three sections such that the fluid flows between the three sections of the fluid chamber.

Preferably, in the second configuration of the inner and outer body members, the resistance mechanism substantially does not resist relative movement of the inner and outer body members. Preferably, the fluid is retained in the fluid chamber by an upper seal and a lower seal. Typically, the jar mechanism forms part of a drilling jar. Typically, in the first configuration, the resistance mechanism co-operates with a piston section.

Preferably, the piston section is mounted on the inner body member. Typically, the valve devices are located in the fluid chamber between the inner and outer body members.

Typically, the resistance mechanism includes a bypass device for permitting the fluid to flow around the respective valve device in a direction opposite to the respective first and second directions. Preferably, when one of the valve devices is restricting the fluid flow, the bypass device permits fluid flow around the other valve device. Typically, the resistance mechanism further comprises a pair of moveable members, where one of the valve devices is mounted on each moveable member. Preferably, each moveable member includes a said bypass device. Preferably, a moveable member is moveable between a first configuration in which the bypass device is inoperative, such that the fluid located in the fluid chamber is forced to pass through the valve device of the same moveable member, and a second configuration in which the bypass device is operative, such that the fluid located in the fluid chamber is permitted to bypass the valve device of the same moveable member.

Preferably, the piston section comprises a releasable coupling device on the inner body member for coupling to each moveable member, such that, when the coupling devices are coupled to the corresponding moveable member, and the inner body member moves relative to the outer body member, the moveable members are moved, and preferably, the valve device of one of the moveable members restricts the fluid flow and the bypass device of the other moveable member bypasses the fluid flow. Typically, when the coupling device is released from the moveable members, the inner body member is not restrained from relative axial movement with respect to the outer body member; that is, the inner and the outer body members are in the said second configuration.

Preferably, the coupling devices of the piston section are enlarged diameter sections of the inner body member which slidably engage the inner circumference of the two moveable members respectively. Preferably the moveable members are moved so that the bypass device of one moveable member is obturated, and the bypass device of the other moveable member is opened, and thus operable.

BRIEF DESCRIPTION OF THE DRAWINGS

An example of a drilling jar in accordance with the invention will now be described, by way of example only, with reference to the accompanying drawings in which:

FIG. 1(*b*) shows the upper middle quarter of the drilling jar in cross section;

FIG. 1(*c*) shows the lower middle quarter of the drilling jar in cross section;

FIG. 1(I d) shows the lower quarter of the drilling jar in cross section;

FIG. 2(*b*) shows a cross section of the inner hydraulic mandrel of FIG. 2(*a*) at section B;

FIG. 2(*c*) shows a cross section of the inner hydraulic mandrel of FIG. 2(*a*) at section C;

FIG. 13(*b*) shows an end view of the lock mandrel of FIG. 13(*a*);

FIG. 14(*b*) shows an end view of the piston of FIG. 14(*a*);

FIG. 15 shows a cross section of the piston of

FIGS. 14(*a*) and 14(*b*) incorporated into the drilling jar of FIG. 1.

DETAILED DESCRIPTION OF A PREFERRED EMBODIMENT

Figure 1A:
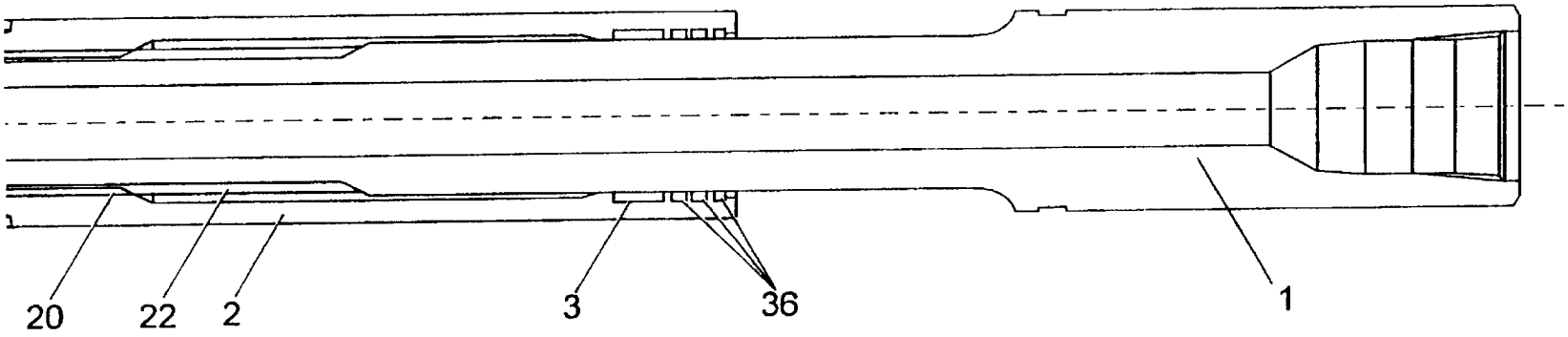
FIG. 1(*a*) shows the upper quarter of a drilling jar in accordance with the present invention, in cross section.
Figure 1C:
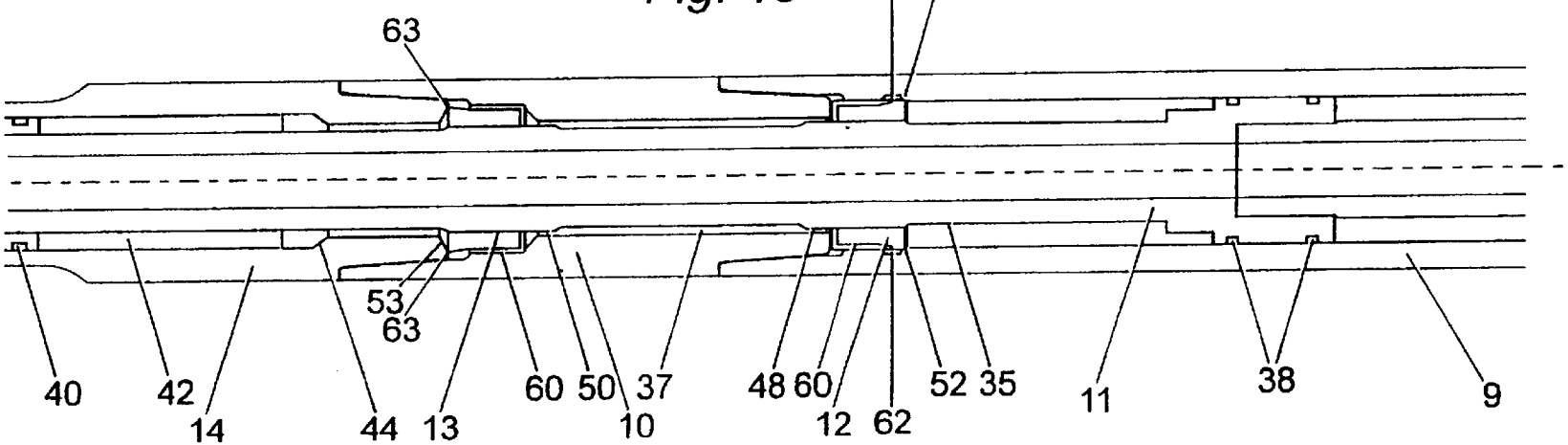
Figure 1B:
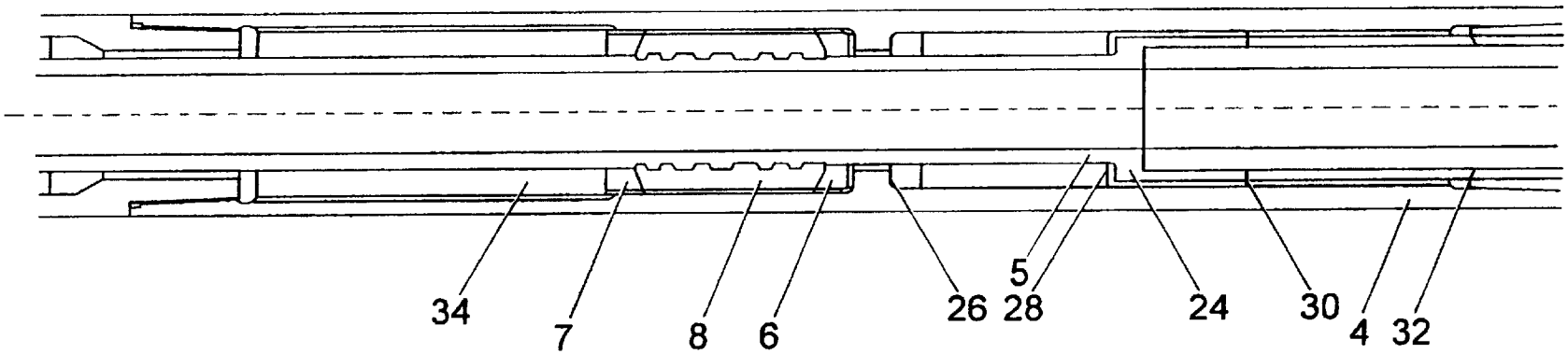
Figure 1D:
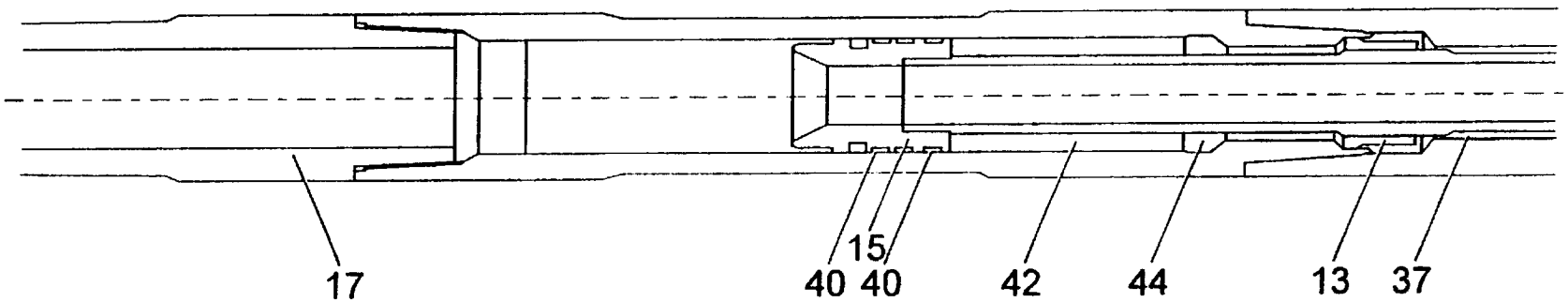

FIGS. 1(*a*), (*b*), (*c*) and (*d*) collectively show a drilling jar in accordance with the present invention. The drilling jar comprises an outer female body 2, 4, 9, 10, 14, 17 and an inner male body 1, 5, 11. A male member 1 is located within a female member 2. The bottom end of the male member 1 is connected to the upper end of a lock mandrel 5 which is in turn connected at its lower end to the upper end of a hydraulic mandrel 11.

The bottom end of the female member 2 is coupled to a spring housing 4 which is in turn coupled at its lower end to the upper end of an upper hydraulic housing 9, which is in turn coupled at its lower end to a lower hydraulic housing 10. The lower hydraulic housing 10 is connected at its lower end to the upper end of a balance housing 14 which is in turn connected at its lower end to the upper end of a bottom sub 17.

The male member 1 is slidably coupled to the female member 2 by a female member bearing 3, which is preferably replaceable. Splines 20 on the female member 2 co-operate with splines 22 on the male member 1, to rotationally lock the male member 1 to the female member 2.

A hammer 24 is mounted on the upper end of the lock mandrel 5, and has a lower surface 28 for striking an inwardly facing shoulder or anvil 26, which is mounted on the lock housing 4, when a downwardly jar mechanism is required. The hammer 24 has an upper impacting surface 30 which strikes the lowest surface 32 of the female member 2 when an upjarring impact is required.

A lock segment 8 is located between the lock housing 4 and the lock mandrel 5 and is biassed radially inward by an upper taper ring 6 and a lower taper ring 7. The upper tapered ring 6 and the lower tapered ring 7 are longitudinally biassed against tapered ends of the lock segment 8 by a longitudinally acting compression spring 34 which acts between the upper end of the upper hydraulic housing 9 and the lower side of the lower taper ring 7. The upper side of the upper taper ring 6 is, accordingly, butted against the lower side of the anvil 26.

Figure 13A:
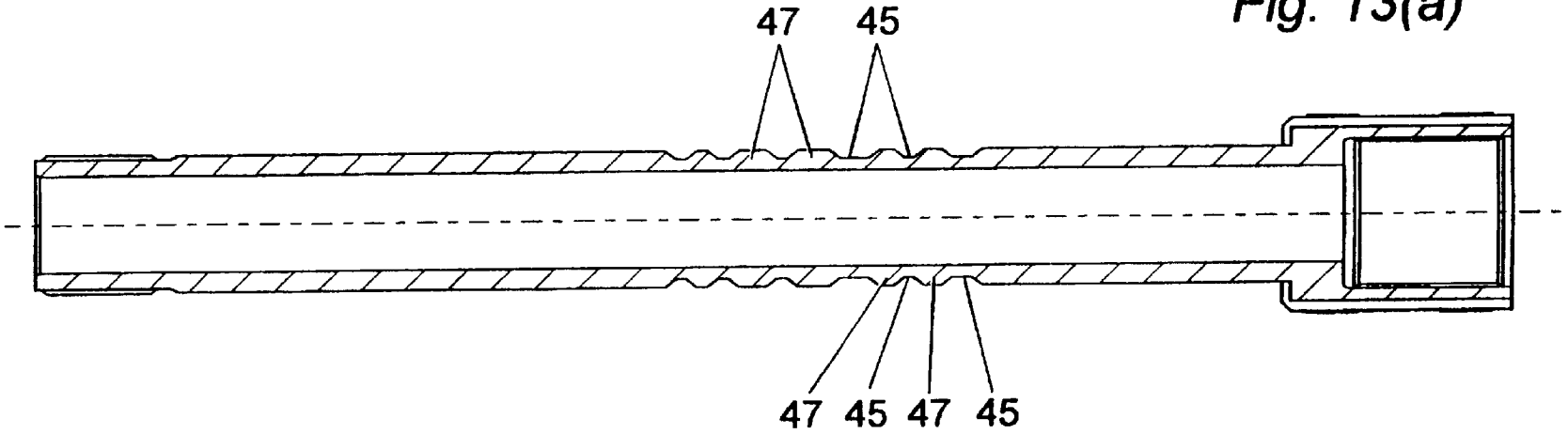
FIG. 13(*a*) shows a cross section of a lock mandrel of the drilling jar of FIG. 1.
Figure 13B:
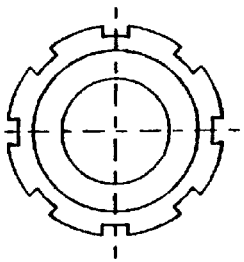
Figure 14A:
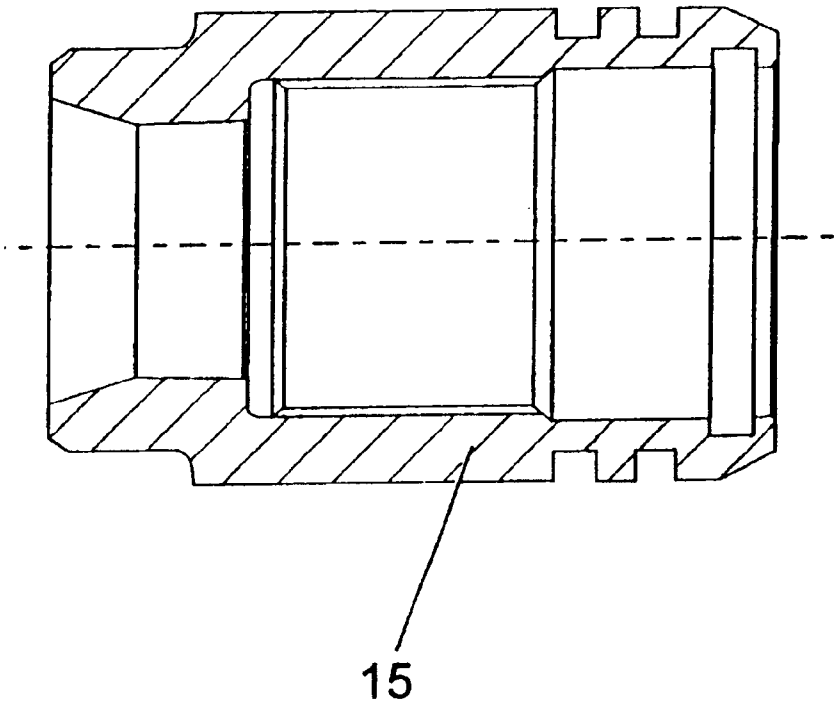
FIG. 14(*a*) shows a cross section of an alternative, and preferred, piston of the drilling jar of FIG. 1.
Figure 14B:
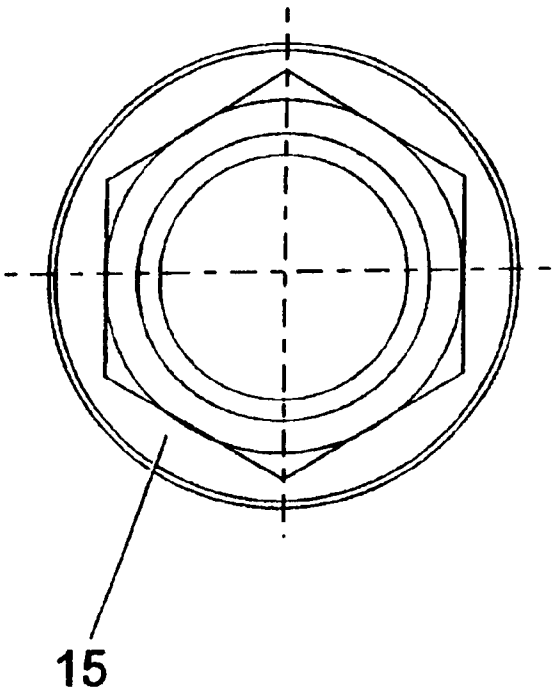
Figure 15:
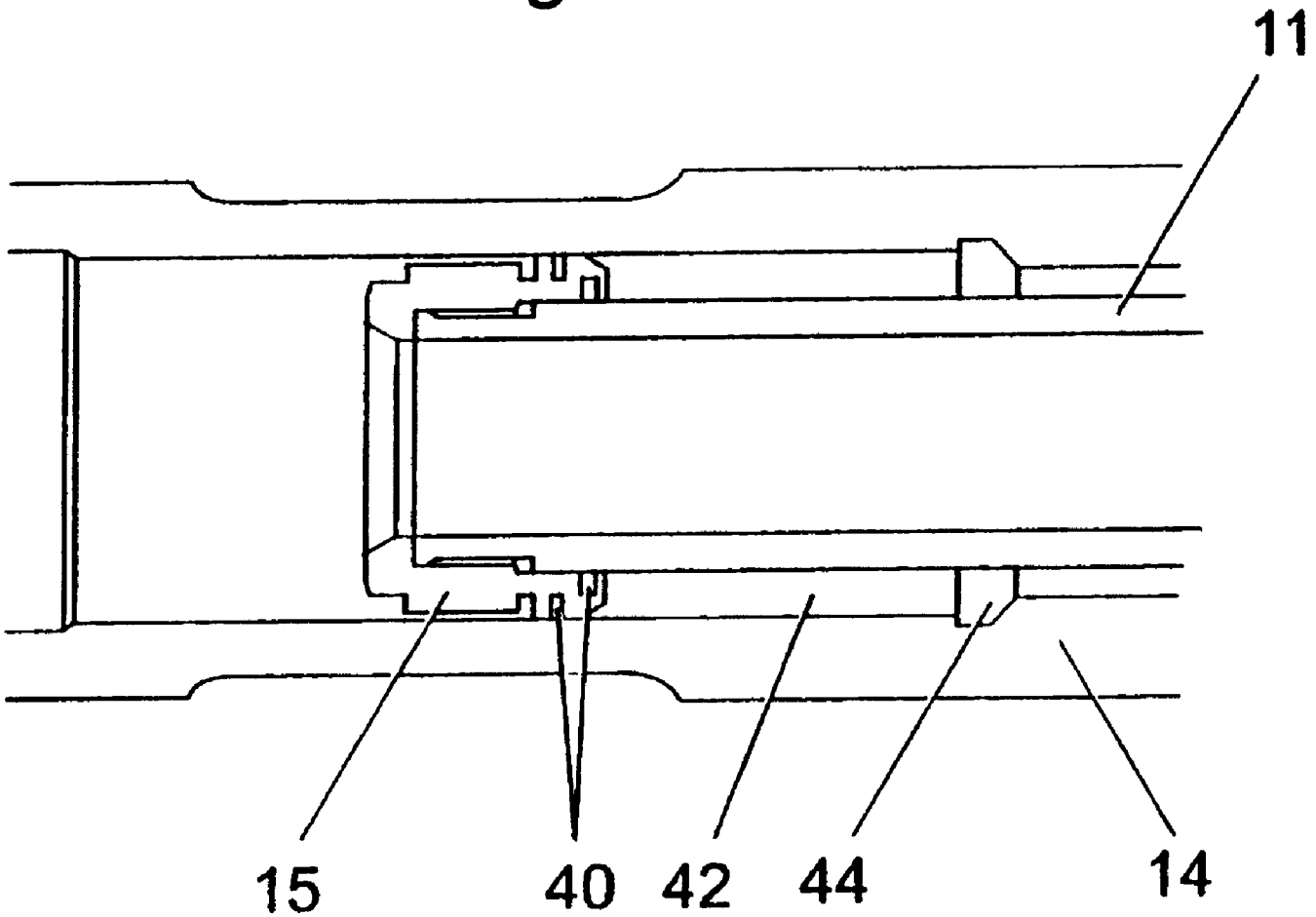
Figure 16:
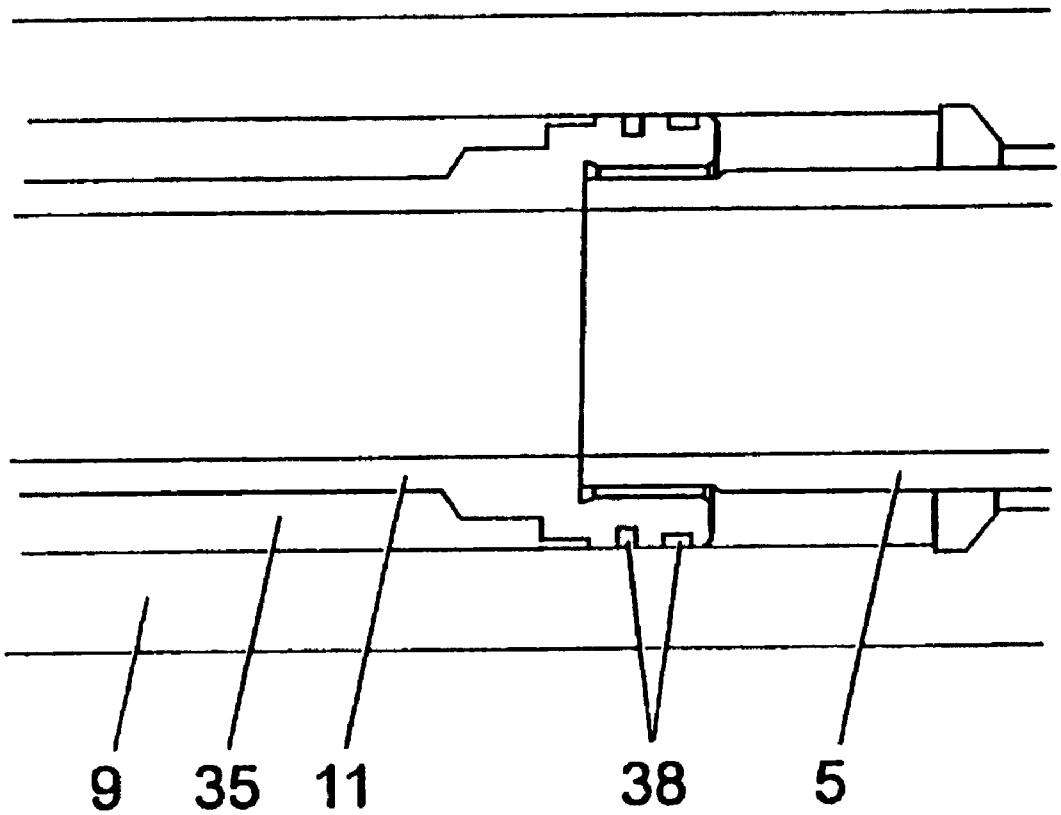
FIG. 16 shows a cross section view of the upper end of the inner hydraulic mandrel of FIG. 2, incorporated in the drilling jar of FIG. 1.

The inner surface of the lock segment 8 comprises a number of ridges 41 and grooves 43 of differing widths. It can be seen, more clearly in FIG. 13 (a), that the lock mandrel 5 has corresponding grooves 45 to accept the lock segment 8 ridges 41 and corresponding ridges 47 to fit the lock segment 8 grooves 43. Because the lock segment 8 grooves 43 and ridges 41 are of differing widths, the lock segment 8 will only lock the lock mandrel 5 in one positional relationship.

For various reasons, it is not possible to achieve as great a downward pushing action on a drill string compared to an upward pulling action. To enable the lock segment 8 and the lock mandrel 5 to become unlocked reasonably easily on a downward pushing action, the downward facing inclines 49 of the lock segment 8 are not as steep as the upward facing inclines 51.

The configuration of the lock segment 8 is detailed in FIGS. 3 and 4, and the configuration of the upper taper ring 6 is detailed in FIGS. 5 and 6 and the configuration of the lower taper ring 7 is detailed in FIGS. 7 and 8 and will be discussed subsequently.

Two different fluids are located between the outer female body 2, 4, 9, 10, 14, 17 and the inner male body 1, 5, 11 and are split into two portions. The first fluid is a lubricating oil and is located between upper wiper seals 36 mounted on the upper end of the female member 2 and seals 38 mounted on the upper end of the hydraulic mandrel 11. The second fluid is a hydraulic fluid and is located in a hydraulic fluid chamber 35, 37, 42 between the seals 38 mounted on the upper end of the hydraulic mandrel 11 and seals 40 mounted on a piston 15 which is screwed onto the lower end of the hydraulic mandrel 11. The piston 15 ensures that there is no contact between drilling fluid located in the central bore of the drilling jar and the hydraulic fluid. The piston 15 is fixed to the bottom end of the hydraulic mandrel 11. Accordingly, it is possible to increase the hydraulic fluid pressure when upjarring, in order to achieve a greater impacting force, by increasing the drilling fluid pressure.

An upper valve 12 is located between the hydraulic mandrel 11 and both the upper and lower hydraulic housings 9, 10. The space between the upper side of the upper valve 12 and the seals 38 mounted on the upper end of the hydraulic mandrel 11 defines an upper region 35 of the chamber for the hydraulic fluid. A lower valve 13 is located between the hydraulic mandrel 11 and both the lower hydraulic housing 10 and the balance housing 14. The space between the lower valve 13 and the piston 40 defines a lower region 42 of the chamber. The upper region 35 and the lower region 42 are linked by a middle region 37 of the chamber, thus allowing fluid to pass between the three regions 35, 37, 42, when possible.

The hydraulic mandrel 11 has a piston section which comprises two spaced apart enlarged diameter sections 48, 50 which are spaced apart by a distance corresponding to the distance between the upper valve 12 and the lower valve 13. The drilling jar is arranged so that when the lock segment 8 is locked, the upper enlarged diameter section 48 acts against the inner circumference of the upper valve 12 and the lower enlarged diameter section 50 acts against the inner circumference of the lower valve 13. Thus, when the enlarged diameter sections 48, 50 are aligned with the corresponding valves 12, 13, no hydraulic fluid is able to pass between the inner circumference of the valve 12, 13 and the enlarged diameter sections 48, 50.

When the male member 1 is pulled upward with enough force to overcome the locking action of the lock segment 8, the hydraulic mandrel 11 is accordingly pulled upwards also. The upper and lower valves 12, 13 also move in an upward direction. The lower valve 13 moves upward such that its lower end no longer butts against the upper end of the balance housing 14. Fluid may now bypass the lower valve 13 through fluid flow passages 60 arranged on the outer circumference of the lower valve 13. However, the upper valve 12 is moved fractionally upwards so that its upper end 62 butts against a shoulder 52 mounted on the upper hydraulic housing 9. This butting movement closes fluid bypass flow passages 60 on the outer circumference of the upper valve 12 and forces the hydraulic fluid to pass through a fluid flow restriction device located within the upper valve 13. The fluid flow restriction device will be detailed subsequently.

When the male member 1 is forced downwards for a downward jar impact, it is the lower side 63 of the lower valve 13 that butts against the upper section 53 of the balance housing 14, which closes the fluid flow bypass passages 60 arranged on the outer circumference of the lower valve 13. In this situation, it is fluid flow bypass passages 60 on the upper valve 12 which are opened to allow the fluid to bypass the upper valve 12. The hydraulic fluid is forced to flow through a fluid flow restriction device located within the lower valve 13.

When either an up or a downward force is applied to the male member 1, the hydraulic fluid is forced to flow through the fluid flow restriction device located in the respective upper or lower valve 12, 13 until the corresponding enlarged diameter section 48, 50 clears the respective upper or lower valve 12, 13. When this occurs, the drilling jar free strokes until the hammer 24 and the anvil 26, 32 collide, because the hydraulic fluid is no longer forced to pass through the fluid flow restriction device but can pass through the annulus between the inner circumference of the respective valve member 12, 13 and the non-enlarged diameter circumference of the hydraulic mandrel 11.

Figure 2A:
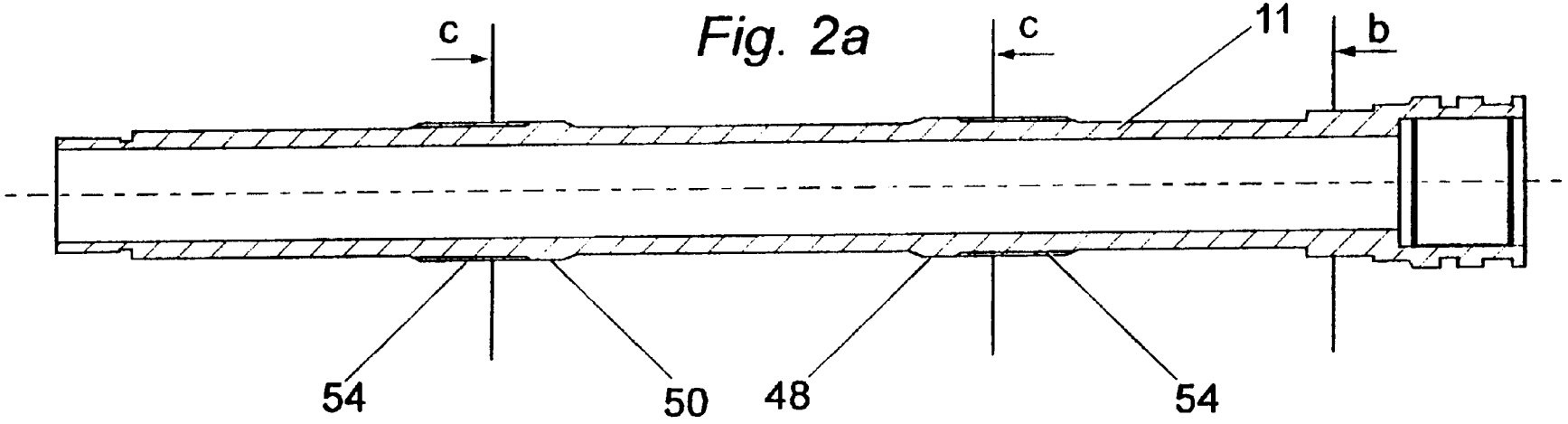
FIG. 2(*a*) shows in cross section an alternative, and preferred, inner hydraulic mandrel of the drilling jar of FIG. 1.
Figure 2B:
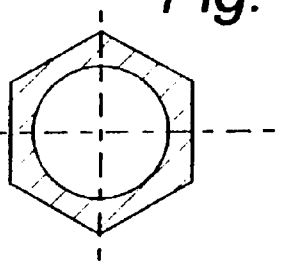
Figure 2C:
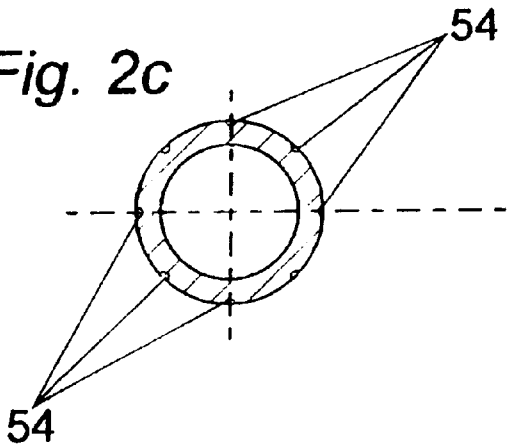

It can be seen in FIG. 2(*a*) that the enlarged diameter sections 48, 50 have small channels 54 formed along a portion of their lengths, the channels 54 being arranged in the same direction as the longitudinal axis of the hydraulic mandrel 11. The channels 54 only extend along the enlarged diameter sections 48, 50 for a portion of their length, and are arranged in the direction away from the other enlarged diameter section, thus providing additional fluid bypass when required. The channels 54 are arranged around the circumference of the enlarged diameter sections 48, 50, and this can be seen in FIG. 2(*c*).

Figure 3:
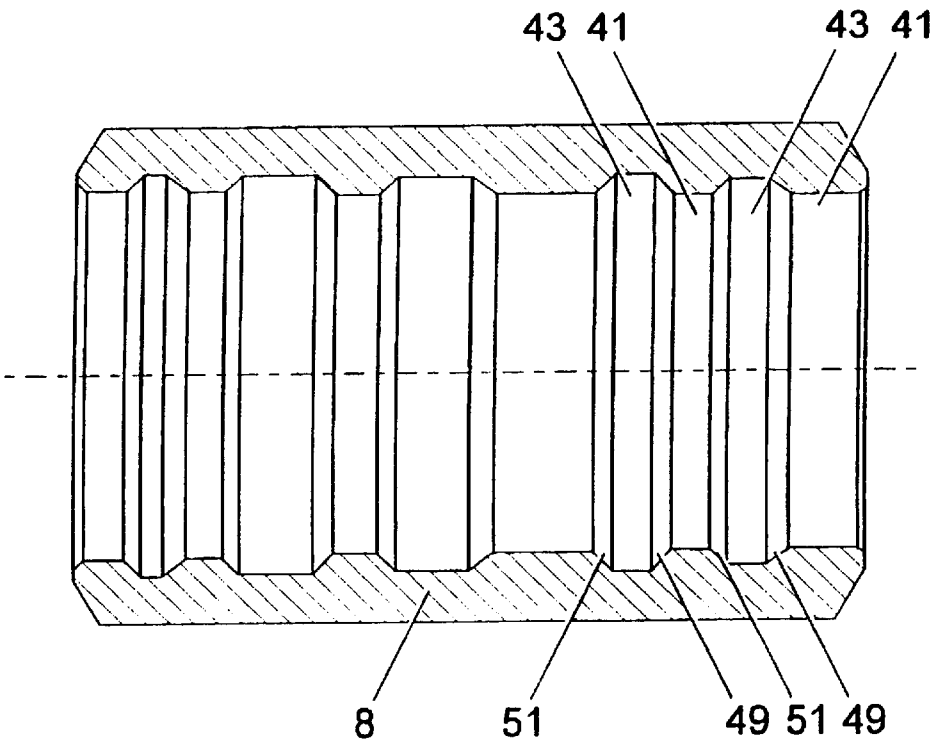
FIG. 3 shows a lock mechanism of the drilling jar of FIG. 1 in cross section.
Figure 4:
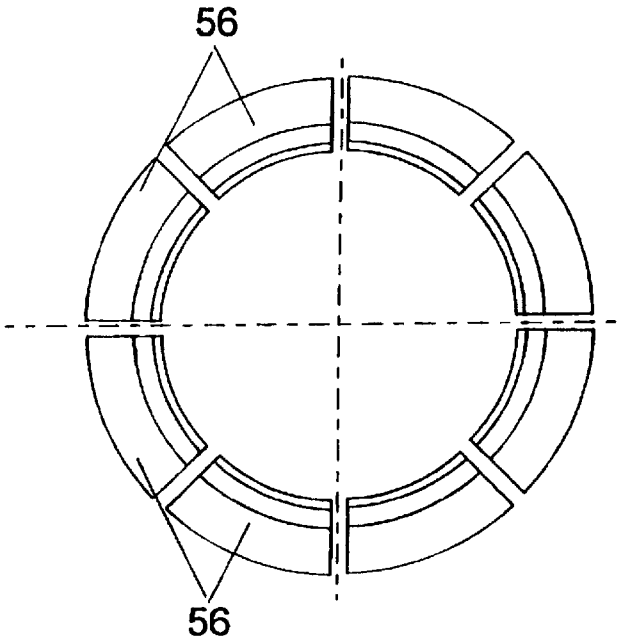
FIG. 4 shows an end view of the lock mechanism of FIG. 3.

FIGS. 3 and 4 show th a t the lock segment 8 is made up of eight circumferential segments 56. The circumferential segments 56 provide flow passages therebetween to allow the lubricating oil located between upper wiper seals 36 and seals 38 to flow through the lock segment 8 without friction.

Figure 5:
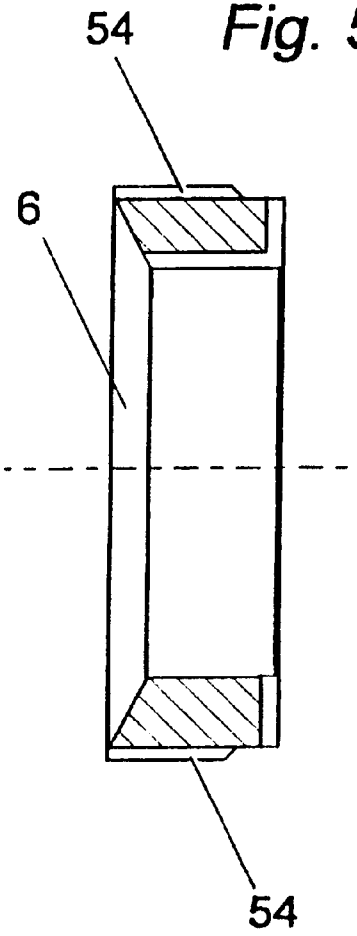
FIG. 5 shows a cross section of an upper taper ring of the drilling jar of FIG. 1.
Figure 6:
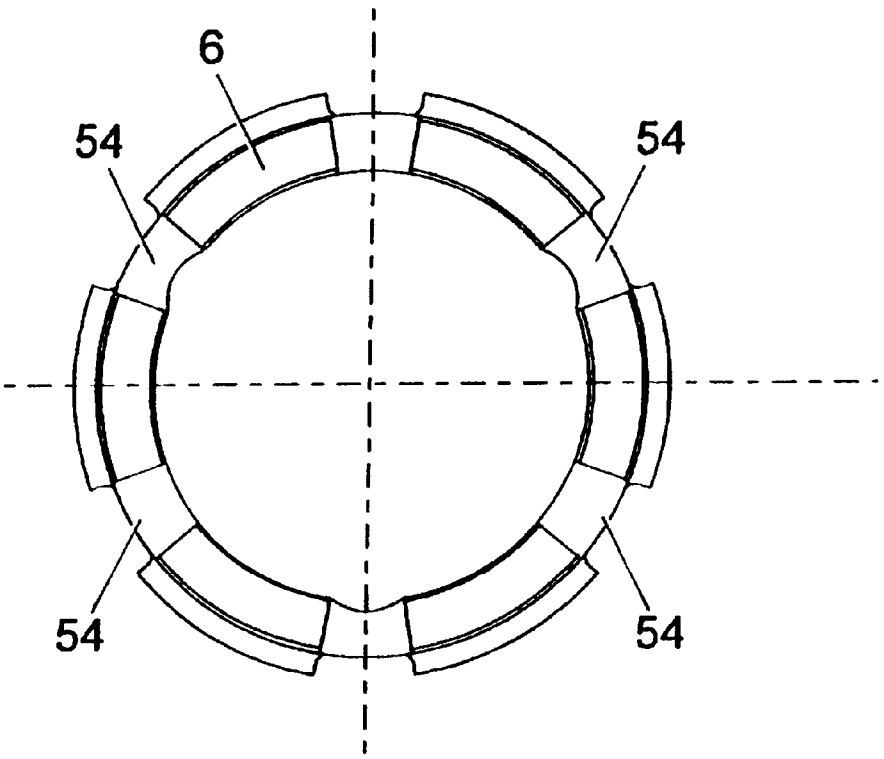
FIG. 6 shows an end view of the upper taper ring of FIG. 5.
Figure 7:
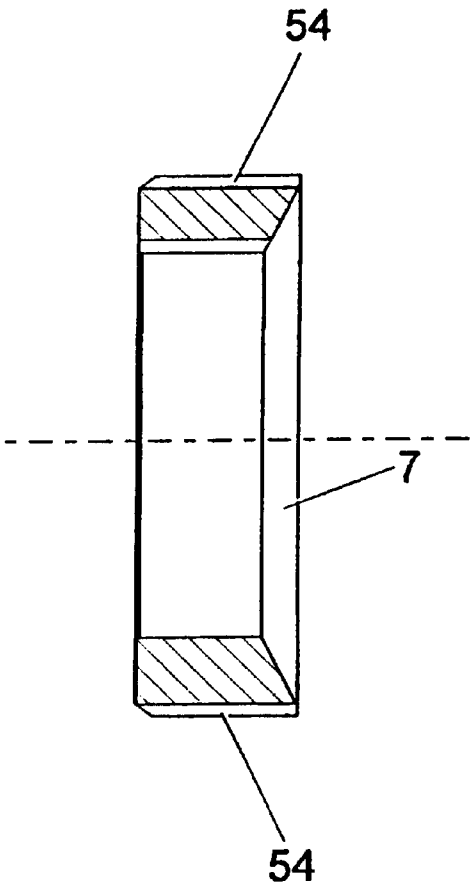
FIG. 7 shows a cross section of a lower taper ring of the drilling jar of FIG. 1.
Figure 8:
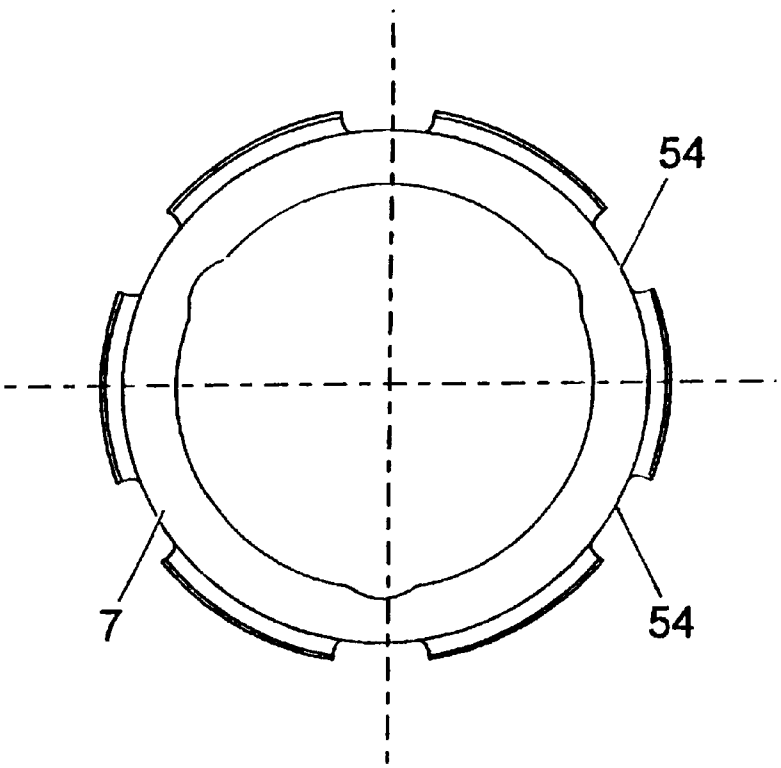
FIG. 8 shows an end view of the lower taper ring of FIG. 7.

FIGS. 5 and 6 which show the upper taper ring 6 and FIGS. 7 and 8 which show the lower taper ring 7 show th a t the taper rings 6 and 7 have fluid flow through passages, which allow the lubricating oil to flow past the taper rings 6, 7 without friction.

Figure 9:
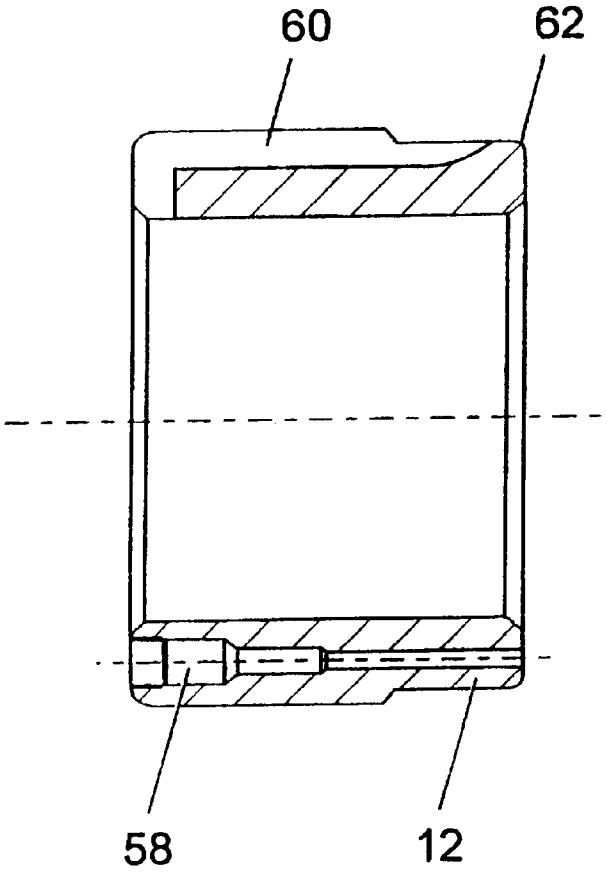
FIG. 9 shows a cross section of an upper valve of the drilling jar of FIG. 1.
Figure 10:
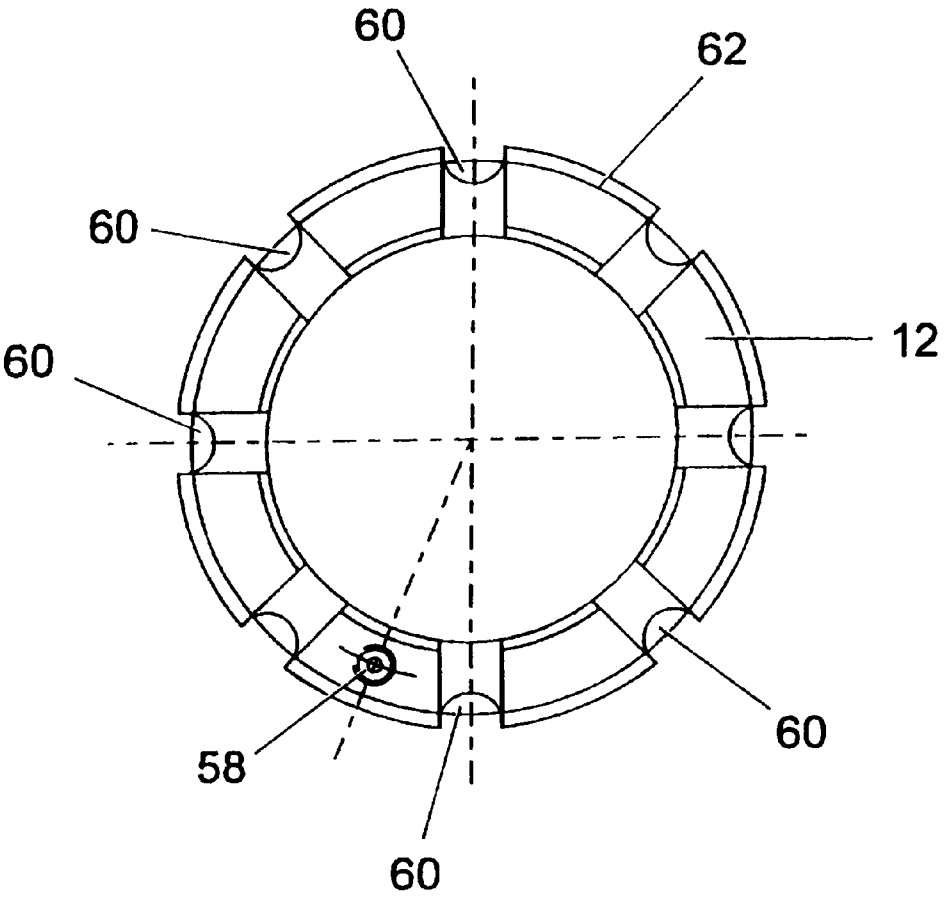
FIG. 10 shows an end view of the upper valve of FIG. 9.

FIGS. 9 and 10 show the upper valve 12 to have a jetting port 58 into which is fitted a flow restrictor (not shown), which resists movement of fluid through it in one direction, one example of which is the commercially available Lee Visco Jet(™) manufactured by the Lee Company. The upper valve 12 has a number of fluid flow bypass passages 60, the upper end 62 of which butts against the shoulder 52 on the upper hydraulic housing 9 when the upper valve 12 is moved upwards. When this occurs, the hydraulic fluid must pass through the flow restrictor. The fluid flow bypass passages 60 are semi-circular in cross section which aids the manufacture of the upper valve 12.

Figure 11:
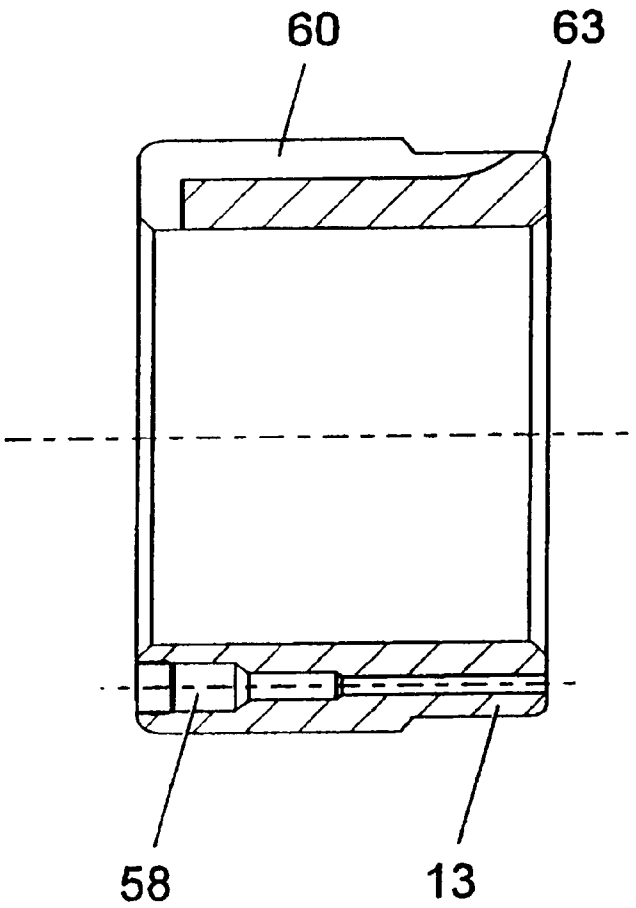
FIG. 11 shows a cross section of a lower valve of the drilling jar of FIG. 1.
Figure 12:
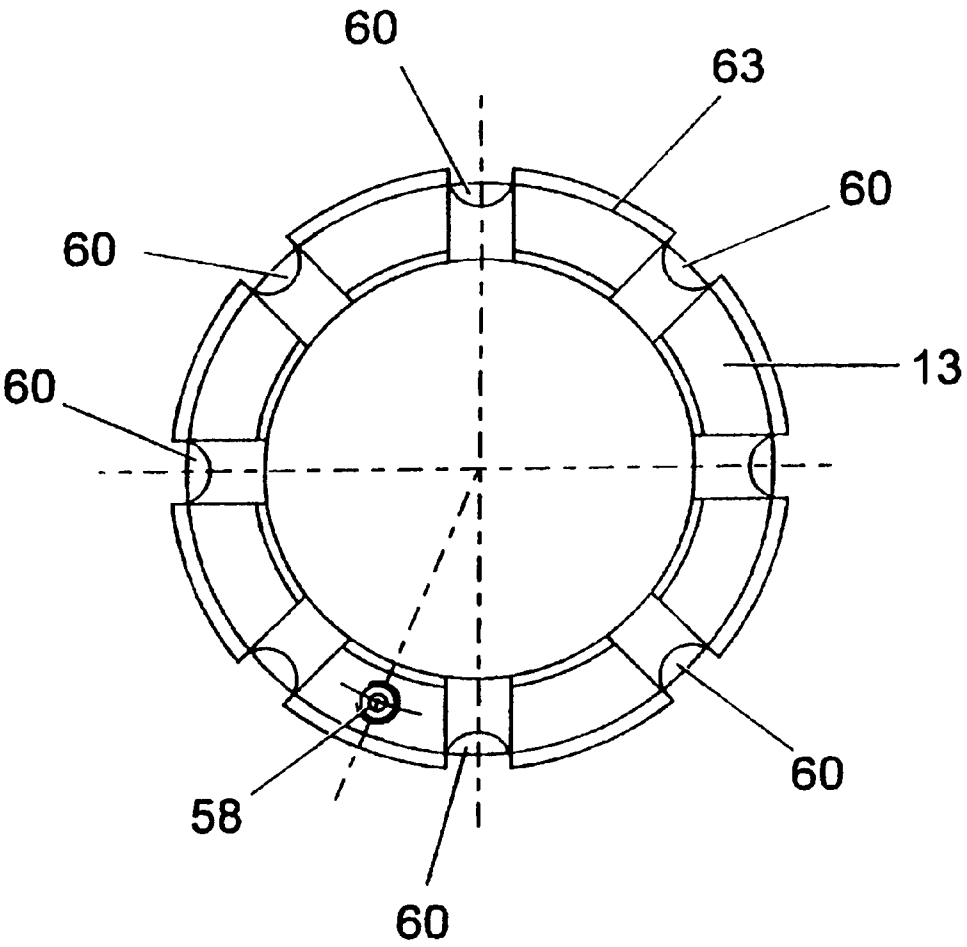
FIG. 12 shows an end view of the lower valve of FIG. 11.

The lower valve 13 is shown in FIGS. 11 and 12 and has a similar arrangement of a jetting port 58 and fluid flow bypass passages 60 as the upper valve 12. However, in order to aid identification of the upper and lower valves 12, 13, the inner diameter of the lower valve 13 is smaller than the inner diameter of the upper valve 12. The corresponding lower enlarged diameter section 50 on the hydraulic mandrel 11 also has a smaller outer diameter than the outer diameter of the upper enlarged diameter section 48. This ensures firstly, that if the upper and lower valves 12, 13 are mistakingly identified and switched when placing them into the drilling jar, that this mistake is noticed when the hydraulic mandrel is placed within the drilling jar. Secondly, it is the lower valve 13 that has the smallest inner diameter, so that the hydraulic mandrel 11 can be fed into the drilling jar.

If one of the valves 12, 13 were to fail, the other valve 12, 13 can still provide a jarring function in its respective direction on the basis that the jars are spaced apart. Accordingly, the valves 12, 13 being spaced apart provides redundancy.

Modifications and improvements may be made to the embodiment without departing from the scope of the present invention.

What is claimed is:

1. A jar mechanism comprising an outer body member; an inner body member movably mounted on the outer body member; a fluid chamber defined by the inner and the outer body members; and a resistance mechanism in fluid communication with the fluid chamber; the inner and the outer body members being movable relative to each other between a first configuration in which the resistance mechanism resists relative movement between the inner and the outer body members, and a second configuration in which the resistance mechanism resists relative movement of the inner and the outer body members to a lesser extent than the first configuration; the resistance mechanism comprising two valve devices, each valve device resisting movement of fluid within the fluid chamber in one direction and the valve devices being arranged to resist the movement of fluid in opposite directions, wherein the inner body member is moveable with respect to the valve devices, and the valve devices divide the fluid chamber into three sections such that the fluid is capable of flowing between the three sections of the fluid chamber.

2. A jar mechanism according to claim 1, wherein the valve devices are arranged in a spaced apart relationship.

3. A jar mechanism according to claim 1, wherein the valve devices are located in the fluid chamber between the inner and outer body members.

4. A jar mechanism according to claim 1, wherein in the first configuration, the resistance mechanism, co-operates with a piston section.

5. A jar mechanism according to claim 4, wherein the piston section is mounted on the inner body member.

6. A jar mechanism according to claim 1, wherein the resistance mechanism further comprises a pair of moveable members, where one of the valve devices is mounted on each moveable member.

7. A jar mechanism according to claim 1, wherein the resistance mechanism includes a bypass device for permitting the fluid to flow around the respective valve device in a direction opposite to the respective first and second directions.

8. A jar mechanism according to claim 7, wherein when one of the valve devices is restricting the fluid flow, the bypass device permits fluid flow around the other valve device.

9. A jar mechanism according to claim 6 wherein each moveable member includes a bypass device for permitting the fluid to flow around the respective valve device in a direction opposite to the respective first and second directions.

10. A jar mechanism according to claim 9, wherein the moveable members are moved so that the bypass device of one moveable member is obturated, and the bypass device of the other moveable member is opened.

11. A jar mechanism according to claim 9, wherein each moveable member is moveable between a first configuration in which the bypass device is inoperative, such that the fluid located in the fluid chamber is forced to pass through the valve device of the same moveable member, and a second configuration in which the bypass device is operative, such that the fluid located in the fluid chamber is permitted to bypass the valve device of the same moveable member.

12. A jar mechanism according to claim 9, wherein in the first configuration, the resistance mechanism co-operates with a piston section, and the piston section comprises a releasable coupling device provided on the inner body member for coupling to each moveable member, such that when the coupling devices are coupled to the corresponding moveable member, and the inner body member moves relative to the outer body member, the moveable members are moved.

13. A jar mechanism according to claim 12, wherein when the moveable members are moved, the valve device of one of the moveable members restricts the fluid flow and the bypass device of the other moveable member bypasses the fluid flow.

14. A jar mechanism according to claim 12, wherein when the coupling device is released from the moveable members the inner body member is not restrained from relative axial movement with respect to the outer body member.

15. A jar mechanism according to claim 12, wherein the coupling devices of the piston section, are enlarged diameter sections of the inner body member which slidably engage the inner circumference of the two moveable members respectively.

16. A jar mechanism comprising an outer body member; an inner body member movably mounted on the outer body member; a releasable locking mechanism for locking the inner body member with respect to the outer body member; and a piston section which permits a load to be applied between the inner body member and the outer body member after the locking mechanism has released, wherein the locking mechanism comprises a first lock member on one of the outer and inner body members, and a second lock member on the other body member, the first and second lock members being engageable with each other to lock the body members together, wherein one of the first and second lock members is biased towards the other by a biasing mechanism, wherein the biasing mechanism comprises a pair of spaced rings, where the first lock member is located between the spaced rings, and at least one biasing device that biases both of the pair of spaced rings toward the first lock member, wherein the spaced rings each have a flow passage formed therein.

17. A jar mechanism according to claim 16, wherein the flow passages are formed on inner and outer circumferences of the pair of spaced rings.

18. A jar mechanism according to claim 16, further comprising at least one flow passage to permit fluid located in an annulus defined between the outer body member and the inner body member to flow from one side of the locking mechanism to the other.

19. A jar mechanism according to claim 16, wherein the locking mechanism is released by applying a force greater than a threshold force between the inner body member and the outer body member.

20. A jar mechanism according to claim 16, wherein the first lock member comprises a plurality of segments, the being arranged circumferentially around the second lock member, and the sum of the angles subtended by the segments is less than 360°.

21. A jar mechanism according to claim 20, wherein there is a flow passage between each segment.

22. A jar mechanism according to claim 16, wherein the first lock member is mounted on the outer body member and the first lock member is biassed towards the second lock member by the biassing mechanism.

23. A jar mechanism according to claim 16, wherein the second lock member comprises a formation on the inner body member.

24. A jar mechanism according to claim 23, wherein the formation has a profile that is engageable by a corresponding profile on the first lock member.

25. A jar mechanism according to claim 16, wherein a side of each of the pair of spaced rings adjacent the first lock member is tapered, and ends of the first lock member are correspondingly tapered with respect to the said side of the pair of spaced rings such that the biasing device biases the pair of spaced rings such that the biasing device biases the rings towards each other to bias the first lock member towards the second lock member.

26. A jar mechanism according to claim 16, wherein the biasing device exerts a biasing force in a direction transverse to the direction of movement of the first lock member.

* * * * *

UNITED STATES PATENT AND TRADEMARK OFFICE

CERTIFICATE OF CORRECTION

PATENT NO. : 6,202,767 B1
DATED : March 20, 2001
INVENTOR(S) : Friis

It is certified that error appears in the above-identified patent and that said Letters Patent is hereby corrected as shown below:

Title page,
Item [57], ABSTRACT line 1 should read:
-- A jar mechanism comprises an outer body member, an inner --

Column 8,
Line 24 should read, -- the coupling device is released is released the moveable members, --
Line 28, should read, -- coupling devices of the piston section are enlarged diameter --
Line 64, should read, -- first lock member comprises a plurality if segnents, the segments --

Signed and Sealed this

Twentieth Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,202,767 B1
DATED : March 20, 2001
INVENTOR(S) : Friis

It is certified that error appears in the above-identified patent and that said Letters Patent is hereby corrected as shown below:

Title page,
Item [57], ABSTRACT line 1 should read:
-- A jar mechanism comprises an outer body member, an inner --

Column 8,
Line 24 should read, -- the coupling device is released from the moveable members, --
Line 28, should read, -- coupling devices of the piston section are enlarged diameter --
Line 64, should read, -- first lock member comprises a plurality of segments, the segments --

This certificate supersedes Certificate of Correction issued November 20, 2001

Signed and Sealed this

Twentieth Day of August, 2002

*Attest:*

*Attesting Officer*

JAMES E. ROGAN
*Director of the United States Patent and Trademark Office*